United States Patent [19]

Blanzy

[11] 4,195,785

[45] Apr. 1, 1980

[54] BURNER STRUCTURE AND METHOD OF MANUFACTURE

[75] Inventor: Eugene J. Blanzy, Center Line, Mich.

[73] Assignee: Lincoln Brass Works, Inc., Detroit, Mich.

[21] Appl. No.: 959,648

[22] Filed: Nov. 13, 1978

[51] Int. Cl.[2] ..... B05B 1/14

[52] U.S. Cl. ..... 239/566; 239/568

[58] Field of Search ..... 239/566, 568, 597

[56] References Cited

U.S. PATENT DOCUMENTS

| | | | |
|---|---|---|---|
| 3,034,733 | 5/1962 | Brooks et al. | 239/568 X |
| 3,269,165 | 8/1966 | Anderson | 239/566 X |
| 3,837,789 | 9/1974 | Schindler | 239/568 X |

*Primary Examiner*—John J. Love

*Attorney, Agent, or Firm*—Barnes, Kisselle, Raisch & Choate

[57] ABSTRACT

In a burner tube having burner ports formed by a series of struck-in tabs, improved structure wherein the tabs have trapezoidal shape to increase the amount of unsevered metal supporting each tab, each tab being formed by cutting through the tube wall along a line perpendicular to the tube axis and then simultaneously bending the tab inwardly and severing the tube wall from the ends of the cut along lines which converge in an outward direction.

6 Claims, 7 Drawing Figures

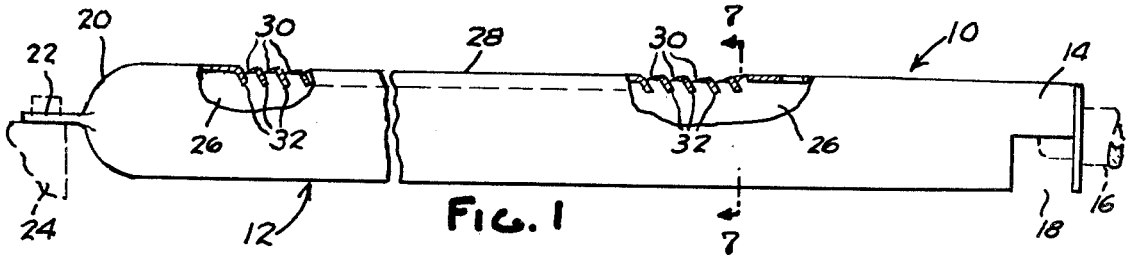
FIG. 1
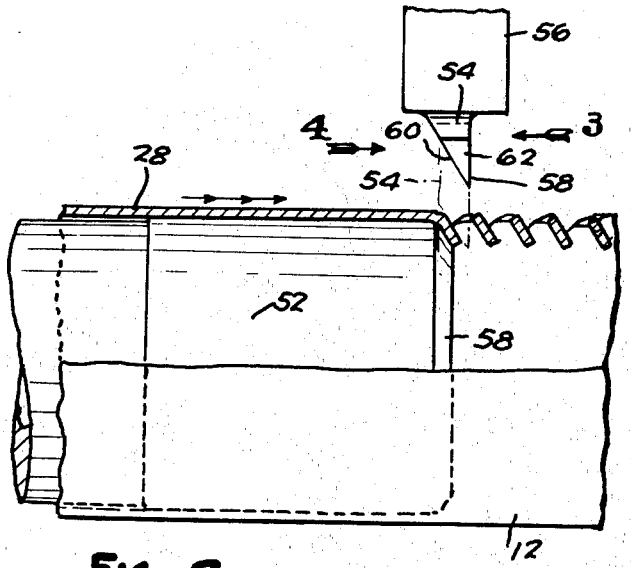
FIG. 2
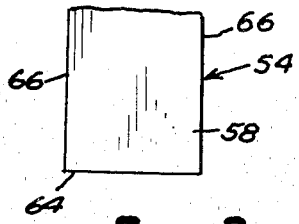
FIG. 3
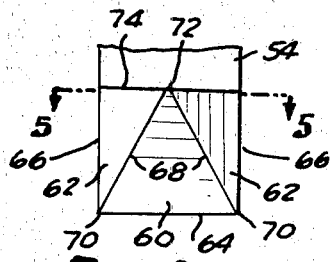
FIG. 4
FIG. 5
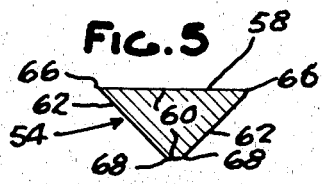
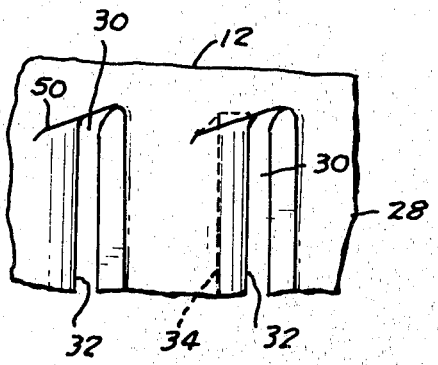
FIG. 6
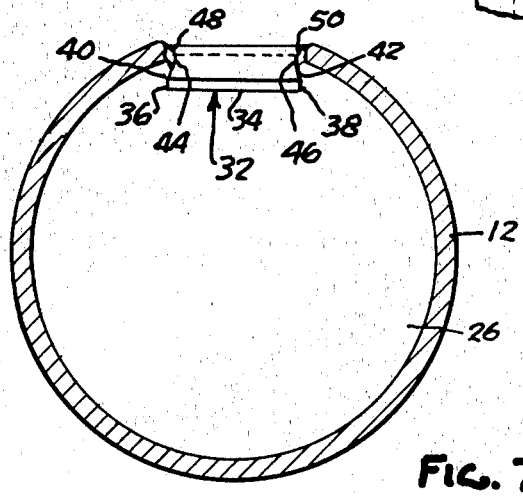
FIG. 7

BURNER STRUCTURE AND METHOD OF MANUFACTURE

This invention relates generally to gas burners and more particularly to burners wherein the burner ports are formed by cutting through the wall of the burner body and bending the severed portions inwardly to form an alternate series of openings and inwardly projecting tabs. Burners of this type are shown for example, in Anderson U.S. Pat. No. 3,269,165.

Burners of this type have the advantage of being relatively inexpensive to make and in general relatively effective in use. However, in unusually corrosive environments the tabs in the conventional burner rust away thereby materially changing the sizes of the burner ports and resulting in improper functioning of the burner. This occurs even when the burner is made of a relatively corrosion resistant material such as 430 stainless steel.

The object of the present invention is to provide a relatively simple, inexpensive burner structure and method of manufacture improved to effectively resist for a longer time corrosive environments and thereby materially increase the useful life of the burner. One form of the invention is shown in the accompanying drawings wherein:

FIG. 1 is a side elevational view of a burner according to the present invention with portions broken away and shown in section.

FIG. 2 is an enlarged scale fragmentary generally elevational view illustrating a burner according to the invention being manufactured.

FIG. 3 is a fragmentary elevational view taken in the direction of arrow 3 of FIG. 2 and showing a tool used in manufacture of the burner.

FIG. 4 is a view of the tool but taken in the direction of the arrow 4 in FIG. 3.

FIG. 5 is a sectional view on line 5—5 of FIG. 4.

FIG. 6 is an enlarged scale fragmentary partly diagrammatic top plan view of a burner according to the invention.

FIG. 7 is an enlarged scale sectional view on line 7—7 of FIG. 1.

Shown in the drawings is a burner 10 in the form of a tube 12 having an upstream end 14 adapted to be supported by and to receive fuel gas from the outlet hood 16 of a conventional gas valve (not shown), end 14 being provided with a primary air inlet opening 18. The downstream end 20 of tube 12 is pinched closed thereby forming a limb 22 supported on suitable means 24 in a conventional furnace, oven or the like. Between ends 14 and 20, the interior of tube 12 forms a gasway 26. A wall portion 28 of tube 12 is provided with an alternately disposed series of burner ports 30 and tabs 32 projecting from the surface of the tube angularly into gasway 26.

In general, ports 30 and tabs 32 are formed by cutting through wall portion 28 and bending the severed portions of the tube wall inwardly. Conventionally, this is done by slitting the tube wall along a line perpendicular to the axis of the tube to form a cut having ends, and then severing the tube wall along parallel lines away from the ends of the cut so that the resulting bent-in tabs are generally rectangular.

In accordance with the present invention, each tab 32 has a shape which for convenience of description may be regarded as at least partially trapezoidal. Thus, each tab 32 has an inner edge 34 with terminals 36 and 38.

Each tab has an end 40 extending outwardly from terminal 36 and an end 42 extending outwardly of terminal 38. Ends 40,42 extend along lines which converge toward each other in an outward direction. This convergence continues until ends 40,42 reach points 44,46 respectively which mark the approximate locations where the cutting of the material of tube 12 to define tabs 32 was discontinued. Thereafter, tabs 32 continue outwardly through regions 48,50 of tube wall material which is unsevered but which is merely bent inwardly. Unsevered regions 48,50 provide material for supporting tab 32 which is not available in conventional burner structures. This additional material extends substantially the length of time through which tabs 32 will survive a corrosive environment in use and thereby effectively extends the useful life of burner 10.

One form of apparatus for forming tabs 32 and the burner ports 30 in burner tube 12 is illustrated in FIGS. 2–4. The apparatus includes a mandrel 52 inserted into tube 12 and a cutting blade 54 mounted on a cutting head 56. Head 56 and knife 54 are aligned with the forward end 58 of mandrel 52 and are circumferentially aligned with portion 28 of tube 12 to be severed for producing burner ports 30. Tube 12 is moved intermittently to the right as FIG. 2 is viewed relative to mandrel 52 and during each dwell period, head 56 reciprocates knife 54 downwardly and upwardly to cut through wall portion 28, bend a tab 32 inwardly and form a burner port 30. The extent of relative movement of the tube and mandrel in each cycle is such that adjacent ports 30 are in mutual flame supporting relation. The machinery and controls for moving tube 12 and head 56 are conventional.

Knife 54 has a flat forward face 58 and a rearward surface which may be described as semi-pyramidal in configuration, having an angularly disposed end face 60 and angularly disposed partial side faces 62 which intersect forward surface 58 to form respectively the leading edge 64 and sides 62 of the knife blade. Faces 66 intersect face 60 along ridges 68 which converge from ends 70 of edge 64 toward an apex 72 adjacent a shoulder 74 which comprises the boundary between the cutting blade portions of knife 54 and the handle portions thereof which are mounted in head 56. Leading edge 64 and ridges 68 form the cutting edges of knife 54 as is brought out in further detail below.

When knife 54 is lowered by head 56 relative to tube 12, leading edge 64 of the knife first penetrates through portion 28 of the tube along a line transverse to the axis of the tube. Thereafter, as knife 54 continues to move downwardly, cutting edges 68 begin to sever the material of the tube starting at the ends 70 of edge 64 and progressing along lines which converge toward apex 72. At the same time, rearwardly angularly disposed face 60 of the knife blade bends the severed portions of the tube material downwardly as represented in FIG. 2. The shearing along converging ridges 68 forms the converging ends 40,42 of tab 32. The simultaneous cutting and bending continues until tab 32 has been bent inwardly to approximately the angle of face 60 whereupon tab 32 and its associated port 30 are completed and head 56 is retracted to draw knife 54 upwardly preparatory to the subsequent cycle of operation.

In typical burners according to the present invention, ends 40,42 of tabs 32 extend at angles in the range of about 45° to about 60° relative to edge 34. Tabs 32 are bent inwardly at an angle ranging from about 30° to about 60° with 45° being preferred in most instances.

Depending upon economical considerations, ports 30 and tabs 32 can be made individually and sequentially as represented in FIG. 2 or they could all be formed simultaneously by apparatus having a knife 54 for each port 30 or they could be formed in groups with the ports and tabs of each group being formed simultaneously. It would also be within the invention to form certain of the ports and tabs simultaneously and others individually and sequentially.

I claim:

1. Burner structure which comprises, a body having an internal gasway defined in part by a wall portion of said body, a series of burner posts in said wall portion each flanked by a pair of tabs extending from the exterior of said wall portion to an inner edge within said gasway, each tab having end portions which extend outwardly from said inner edge, said end portions converging toward each other in an outward direction, each said end portion, at a location inward of said exterior of said wall portion, adjoining an inwardly bent, unsevered region of said wall portion, each tab continuing outwardly from said end portions in said regions.

2. The structure defined in claim 1 wherein each of said end portions is angled to said inner edge in the range of about 45° to about 60°.

3. The structure defined in claim 2 wherein each of said end portions is angled to said inner edge at about 45°.

4. The structure defined in claim 2 wherein said tabs are disposed at an angle to said wall portion in the range of about 30° to about 60°.

5. The structure defined in claim 4 wherein said angle is about 45°.

6. The structure defined in claim 1 wherein said body comprises a tube having an axis, said series being substantially parallel to said axis, each of said end portions being angled to said inner edge at about 45° and said tabs being angled to said wall portion at about 45°.

* * * * *